United States Patent [19]

Michael et al.

[11] Patent Number: 4,840,055

[45] Date of Patent: Jun. 20, 1989

[54] DRAWING APPARATUS IN A PRESS

[75] Inventors: Wolfgang Michael, Goeppingen; Martin Kaletka, Boll, both of Fed. Rep. of Germany

[73] Assignee: L. Schuler GmbH, Goeppingen, Fed. Rep. of Germany

[21] Appl. No.: 147,893

[22] Filed: Jan. 25, 1988

[30] Foreign Application Priority Data

Jan. 24, 1987 [DE] Fed. Rep. of Germany ..... 3702069

[51] Int. Cl.[4] ..... B21D 45/04; B21D 22/20

[52] U.S. Cl. ..... 72/345; 72/347; 72/351; 92/27; 92/28; 267/119

[58] Field of Search ..... 72/344, 345, 351, 347; 267/119; 92/24, 27, 28

[56] References Cited

U.S. PATENT DOCUMENTS

| | | | |
|---|---|---|---|
| 1,846,439 | 2/1932 | Rode et al. | 267/119 |
| 2,584,339 | 2/1952 | Georgeff | 72/347 |
| 3,005,431 | 10/1961 | Moller | 267/119 |
| 3,237,726 | 3/1966 | Deyerling | 92/27 |
| 3,456,478 | 7/1969 | Alexander | 72/351 |
| 3,575,087 | 4/1971 | Sherwood | 92/28 |
| 4,185,539 | 1/1980 | Stratienko | 92/27 |
| 4,524,676 | 6/1985 | Rogers | 92/27 |

FOREIGN PATENT DOCUMENTS

| | | | |
|---|---|---|---|
| 656684 | 2/1938 | Fed. Rep. of Germany | 72/345 |
| 2408096 | 8/1975 | Fed. Rep. of Germany | 72/345 |

*Primary Examiner*—Robert L. Spruill
*Attorney, Agent, or Firm*—Barnes & Thornburg

[57] ABSTRACT

A drawing apparatus in a press for holding the sheet metal part during the drawing and for the ejection thereof. Additionally, blocking devices are provided which prevent the ejection of the sheet metal draw part at the same time with the upward movement of the press ram. Each blocking device is thereby to be rendered selectively operable or inoperable. A continuous flow of the hydraulic liquid is to be precluded during the inoperative condition of the blocking device. The blocking device consists of a pressure cylinder, of a pressure piston which is displaceably movable on the piston rod displaceable by the draw cushion, and of a compression spring for the displacement of the pressure piston in the ejection direction. The pressure space formed above the pressure piston is selectively pressureless for the inoperative condition, respectively, adapted to be acted upon with controlled pressure for the operative condition of the blocking device. The arrangement enables, on the one hand, the operation of a press and especially of a transfer press with large stroke numbers; with the latter without the operation of the transfer device effecting the transfer movement of the sheet metal draw parts, on the other, the operation with reduced stroke number of the press under utilization of the blocking device.

8 Claims, 2 Drawing Sheets

DRAWING APPARATUS IN A PRESS

BACKGROUND AND SUMMARY OF THE INVENTION

The present invention relates to a drawing apparatus in a press, with a pressure plate or pressure member which is adapted to be lifted and lowered by way of draw cylinders adapted to be acted upon by means of elastically operating pressure media for the counter-holding during the drawing operation and for the ejection of the sheet metal draw part and which includes at least one blocking device for the delayed trailing of the pressure plate to the upward movement of the press ram.

In order to avoid the simultaneous lifting of the pressure plate with the upward movement of the press ram and therewith an immediate lifting of the sheet metal draw part out of the bottom tool, the pressure plate is retained initially in the lowered position by way of a blocking cylinder until the ram has traversed a return stroke of, for example, more than the drawing depth.

It is known from the DE-PS No. 656 684 to connect the blocking cylinder with the drawing apparatus in that the piston rod of the blocking cylinder is simultaneously piston rod of the draw cushion. It is known from the DE-AS No. 24 08 096 to permit the piston rod, of the draw cushion, and the piston rod of a blocking cylinder to act separately on the pressure plate. The valve-controlled flow of hydraulic liquid between the pressure spaces above and below the pressure piston in the blocking cylinder during the drawing and the ejection of the sheet metal drawing part is common to both drawing apparatus. The hydraulic liquid is thereby heated up to a not-insignificant extent. The flow characteristics of the hydraulic liquid change. The heat must be removed under additional energy losses. The flow of the hydraulic liquid in the blocking device reduces the velocity of the draw cushion during the upward movement.

In contrast thereto, it is the object of the present invention to cause the blocking device to be selectively rendered operable or inoperable. A continuous flow of hydraulic liquid during the periods of time of the inoperative condition is thereby to be precluded.

The underlying problems are solved according to the present invention in that the pressure piston is displaceably supported on the piston rod pivotally connected with the pressure plate, in that the piston rod protrudes out of the side opposite the operating or active surface of the pressure piston and includes thereat an abutment, and in that the side of the pressure piston opposite the operating or active surface is constantly acted upon with pressure so that the pressure piston will move away from the abutment when the operating or active surface of the pressure piston is not acted upon with a pressure, and the pressure piston is placed against the abutment when the operating or active surface of the pressure piston is acted upon with the pressure of a hydraulic liquid.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figure 1A:
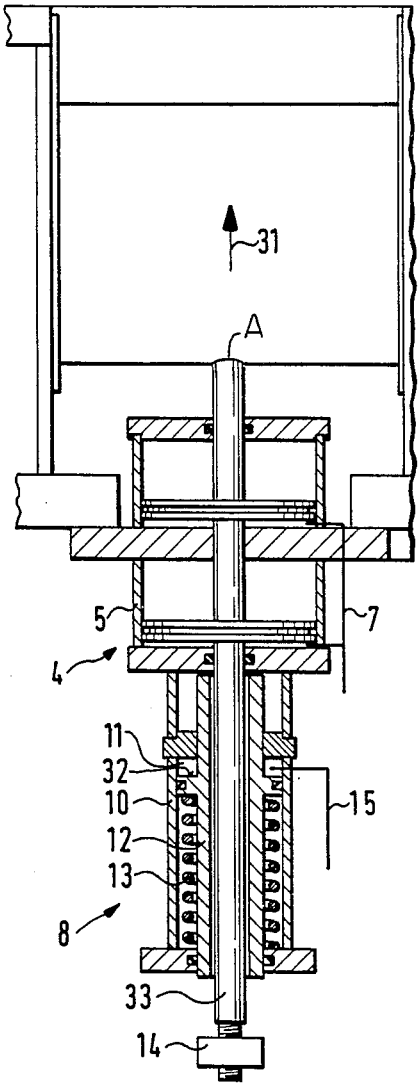
FIG. 1*a* is a vertical cross-sectional view through a drawing apparatus in accordance with the present invention with the blocking device in the inoperative position thereof.
Figure 1B:
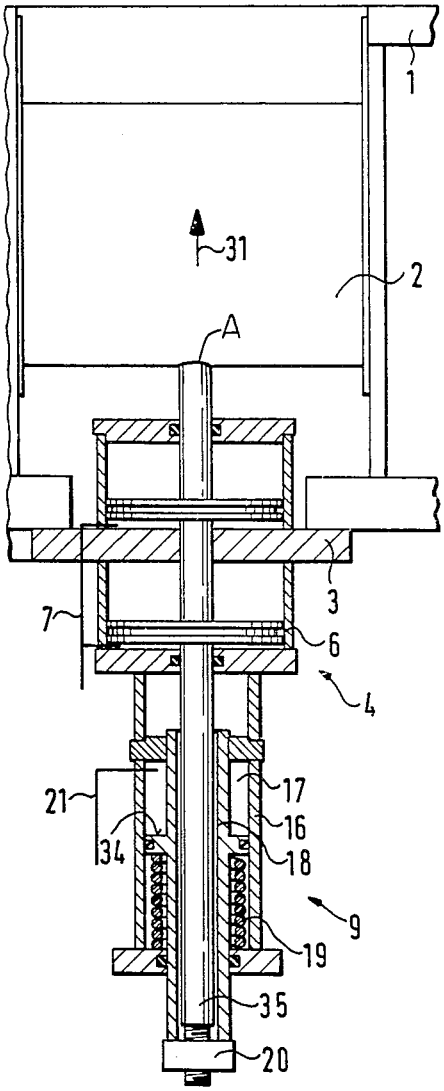
FIG. 1*b* is a cross-sectional view, similar to FIG. 1a, however with the blocking device in the operative position.

Referring now to the drawing wherein like reference numerals are used throughout the various views to designate like parts, the same components are utilized for the embodiments in FIGS. 1*a* and 1*b*. Of a press, for example, of a transfer press, only the part of a press table 1 of a deforming stage which accommodates the drawing apparatus is indicated in the drawing. The drawing apparatus which acts on a pressure plate or pressure member 2 includes one or several draw cushions generally designated by reference numeral 4 as well as blocking devices generally designated by reference numerals 8 and 9 which act on the pressure plate 2 by way of the draw cushions 4. The drawing apparatus is secured at a plate-like bracket 3 which is fixed in the press. The draw cushions 4 are formed by draw cylinders 5 and 6 whose pressure spaces are adapted to be acted upon by pressure in a known manner by way of pressure lines 7 for the drawing and ejection operation of sheet metal draw parts shaped in the deforming stage. One pressure cylinder 10, 16 each is rigidly secured underneath the draw cylinders 5, 6 and concentric thereto. The piston rod 33, 35 of each draw cushion 4 is pivotally attached to pressure plate 2 at A and extended downwardly and guided through the pressure cylinder 10, 16 connected underneath the draw cushions 4 and is arranged displaceable in height within the pressure cylinder 10, 16. A pressure piston 12, 18 is displaceably supported on each piston rod 33, 35. The interior space of each pressure cylinder 10, 16 is subdivided by the pressure piston 12, 18 into an upper pressure space 11, 17 adapted to be acted upon by way of a pressure line 15, 21 and into a lower pressure space including a compression spring 13, 19. The compression spring 13, 19 is supported at the interior bottom of the pressure cylinder 10, 16 and at the pressure piston 12, 18. The pressure piston 12, 18 is thereby continuously pressed upwardly in the direction of the arrow 31 indicating the operating or active direction of the counter-holding system during the drawing. In lieu of the compression spring 13, 19, the pressure space accommodating the same is also adapted to be acted upon by an elastic, in particular, compressible pressure medium which acts in the same manner. The piston rod 33, 35 is provided at its lower end with an abutment 14, 20 adjustable in height. Each pressure piston 12, 18 forms an operating or active surface 32, 34 which delimits the pressure space 11, 17 in the downward direction. With pressure actuation of the pressure space 11, 17 with a hydraulic liquid, the pressure piston 12, 18 is movable downwardly toward the abutment 14, 20 against the action of the spring 13, 19. In order to attain the inoperative condition of the blocking device 8, 9, the product of the pressure in the pressure space 11, 17 and the size of the active surface 32, 34 is to be selected greater than the product of pressure in the draw cushion 4 and the size of the active surfaces thereof, in addition to the force of the compression spring 13, 19. The significant advantage thereby resides in that for the inoperative condition of the blocking device 8, 9, no hydraulic liquid has to be moved continuously from the upper pressure space 11, 17 into the lower pressure space. For the duration of time of the operation of the blocking device 8, 9, the hydraulic liquid is deliberately controllable by way of the control circuit according to FIG. 2.

Figure 2:
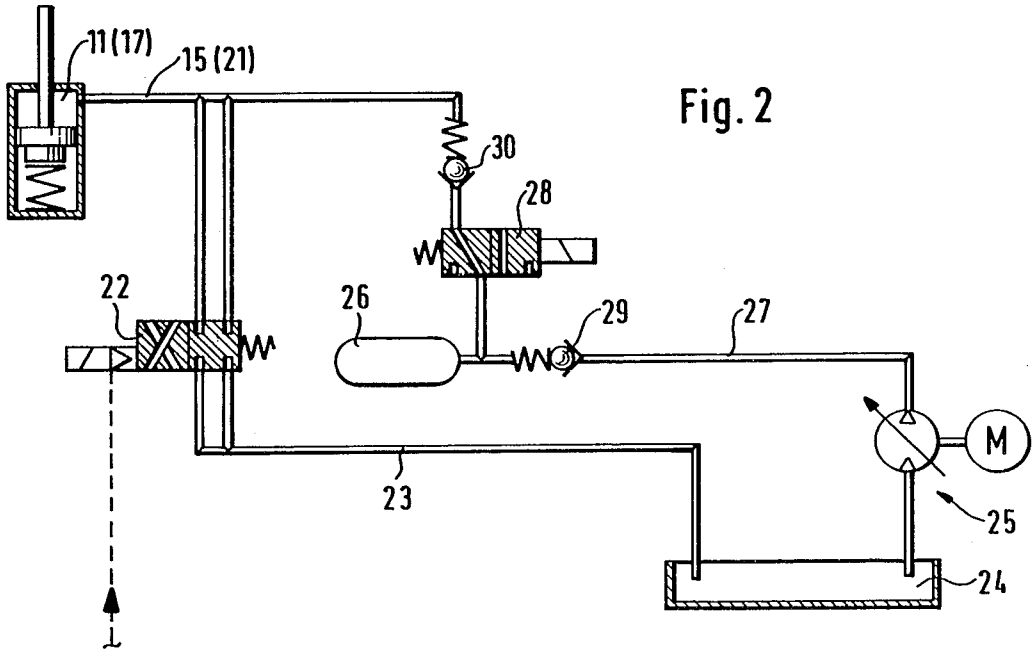
FIG. 2 is a schematic diagram of a control arrangement in accordance with the present invention for the pressure actuation of the pressure space of the blocking device.

FIG. 2 illustrates the essential components and the arrangement thereof in order to achieve the two operating conditions, types of operation of the blocking device according to FIGS. 1a and 1b. The pressure space 11, 17 of the blocking device is connected by way of the pressure line 15, 21, a check valve 30, and a 2/2 directional control valve 28 to a pressure reservoir 26. The pressure within the pressure reservoir is produced by a motor-pump-aggregate generally designated by reference numeral 25 by way of the pressure line 27 and a check valve 29. Filters, lubricating devices, water separator, pressure accumulator, means for the pressure reduction and pressure indication and the like are not shown in the control circuit because these means and the use thereof are generally known. The pressure space 11, 17 is further connected by way of a discharge line 23 into which a throttling directional valve 22 is interconnected, with a pan 24 for hydraulic liquid. If the operating condition of the blocking device illustrated in FIG. 1a is to prevail, the directional valve 22 in FIG. 2 has to be brought into the open position and to be kept in such position so that the pressure in the pressure space 11 decreases and the pressure piston 12 lifts off from the abutment 14 by means of the compression spring 13. The operating condition illustrated in FIG. 1b is attainable by pressure build up in the pressure space 17 and displacement of the pressure piston 18 against the action of the compression spring 19. The phase in which the pressure plate 2 is trailing the upward movement of the press ram, beginning and velocity, is dependent on the respective (instantaneous) ram position and requires the control of the throttling directional valve 22 by way of, for example, ram-synchronous cam pick-ups. This means the throttling directional valve 22 has to be opened after the press ram has carried out a return stroke, for example, of the magnitude of the drawing stroke. The velocity of the trailing of the pressure plate 2 is to be predetermined by the selection of the corresponding throttling cross section of the throttling directional valve 22.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A drawing apparatus in a press, comprising pressure plate means, which is raised and lowered by draw cushion means driven by an operating pressure media, for the counter-holding of a sheet metal draw part during the drawing operation in an active direction and for the ejection of the sheet metal draw part, at least one blocking means for delaying the upward movement of the pressure plate means to the upward movement of a press ram including pressure cylinder means and pressure piston means with an active surface coordinated with a pressure space and adapted to be acted upon by a hydraulic liquid from a pressure line in a direction opposite the active direction of the counter-holding during the drawing operation, piston rod pivotably connected with the pressure plate means, the pressure piston means being displaceably supported on the piston rod, the piston rod, protruding out of the side opposite the active surface of the pressure piston means and including thereat an abutment, and the side of the pressure piston means opposite the active surface being continuously acted upon by pressure so that the pressure piston means will move away from the abutment when the active surface of the pressure piston means is not acted upon with a pressure and the pressure piston means is placed against the abutment when the active surface of the pressure piston means is acted upon with the pressure of a hydraulic liquid from the pressure line.

2. A drawing apparatus according to claim 1, wherein the side of the pressure piston means opposite the active surface is acted upon during the drawing by a compression spring with pressure in the operating direction of the counter-holding.

3. A drawing apparatus according to claim 1, wherein the side of the pressure piston means opposite the active surface is acted upon during the drawing by an elastically acting pressure medium in the operating direction of the counter-holding.

4. A drawing apparatus according to claim 1, wherein the pressure piston means and the piston rod together with the abutment are extended downwardly out of the pressure cylinder means.

5. A drawing apparatus according to claim 4, wherein the side of the pressure piston means opposite the active surface is acted upon during the drawing by a compression spring with pressure in the operating direction of the counter-holding.

6. A drawing apparatus according to claim 4, wherein the side of the pressure piston means opposite the active surface is acted upon during the drawing by an elastically acting pressure medium in the operating direction of the counter-holding.

7. A drawing apparatus according to claim 4, wherein the pressure line of the pressure space coordinated to the active surface at the pressure piston means is operatively connected by way of a directional valve means to a pressure supply including a motor pump aggregate and a pressure reservoir and is operatively connected by way of a throttling directional valve means to a pan for hydraulic liquid, and in that the throttling directional valve means is controllable in dependence both on the movement of the press ram and also on the manner of operation.

8. A drawing apparatus according to claim 1, wherein the pressure line of the pressure space coordinated to the active surface at the pressure piston means is operatively connected by way of a directional valve means to a pressure supply including a motor pump aggregate and a pressure reservoir and is operatively connected by way of a throttling directional valve means to a pan for hydraulic liquid, and in that the throttling directional valve means is controllable in dependence both on the movement of the press ram and also on the manner of operation.

* * * * *